US007398855B2

(12) United States Patent
Seel

(10) Patent No.: US 7,398,855 B2
(45) Date of Patent: Jul. 15, 2008

(54) COMPRESSOR SOUND ATTENUATION ENCLOSURE

(75) Inventor: Robert V. Seel, Dublin, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 98 days.

(21) Appl. No.: 11/125,893

(22) Filed: May 10, 2005

(65) Prior Publication Data

US 2005/0274569 A1 Dec. 15, 2005

Related U.S. Application Data

(60) Provisional application No. 60/571,630, filed on May 14, 2004.

(51) Int. Cl.

| | |
|---|---|
| ***H02K 5/24*** | (2006.01) |
| ***H02K 5/08*** | (2006.01) |
| ***G10K 11/16*** | (2006.01) |
| *H02K 5/02* | (2006.01) |
| *H02K 5/04* | (2006.01) |
| *G10K 11/168* | (2006.01) |

(52) U.S. Cl. ..... 181/202; 181/200

(58) Field of Classification Search ..... 181/202, 181/200, 198

See application file for complete search history.

(56) References Cited

U.S. PATENT DOCUMENTS

| | | | | | |
|---|---|---|---|---|---|
| 3,815,705 | A | * | 6/1974 | Bennett | 181/230 |
| 3,929,207 | A | * | 12/1975 | Urban | 181/198 |
| 3,960,237 | A | * | 6/1976 | Sleeper | 181/200 |
| 4,110,876 | A | * | 9/1978 | Weiss et al. | 28/271 |
| 4,347,043 | A | * | 8/1982 | Morris | 417/53 |
| 4,892,413 | A | * | 1/1990 | Vats | 366/349 |
| 4,914,929 | A | * | 4/1990 | Shimazaki | 62/515 |
| 4,982,812 | A | | 1/1991 | Hwang | |
| 4,991,406 | A | * | 2/1991 | Fujii et al. | 62/296 |
| 5,151,018 | A | * | 9/1992 | Clendenin et al. | 417/312 |
| 5,272,285 | A | | 12/1993 | Miller | |
| 5,274,200 | A | * | 12/1993 | Das et al. | 181/202 |
| 5,588,810 | A | | 12/1996 | DiFlora et al. | |
| 5,881,990 | A | * | 3/1999 | Kawamura | 248/638 |
| 5,997,258 | A | | 12/1999 | Sawyer, III et al. | |
| 6,062,033 | A | | 5/2000 | Choi | |
| 6,604,603 | B1 | * | 8/2003 | Wirth | 181/200 |
| 2005/0056481 | A1 | * | 3/2005 | Mafi et al. | 181/202 |

FOREIGN PATENT DOCUMENTS

| | | | |
|---|---|---|---|
| EP | 0 388 525 | A1 | 9/1990 |
| JP | 06067678 | A * | 3/1994 |

OTHER PUBLICATIONS

The Trane Company, "Trane™ XL 1200 Super Efficiency Weathertron® Heat Pump" Pub. No. 72-1027-2, American Standard Inc. 1986, 4 Pages.

* cited by examiner

*Primary Examiner*—Edgardo San Martin
(74) *Attorney, Agent, or Firm*—Harness, Dickey & Pierce, P.L.C.

(57) ABSTRACT

A sound attenuating cover for a scroll compressor is provided. The cover has a base member configured to support the compressor, the base defines a first chamber filled with a sound attenuating material. The sound attenuating chamber further has a cover member configured to cover the compressor and couple to the base, said cover member defines another chamber. This chamber is additionally filled with a sound attenuating material.

19 Claims, 11 Drawing Sheets

COMPRESSOR SOUND ATTENUATION ENCLOSURE

CROSS-REFERENCE TO RELATED APPLICATIONS

This application claims the benefit of U.S. Provisional Application No. 60/571,630, filed on May 14, 2004. The disclosure of the above application is incorporated herein by reference.

FIELD OF THE INVENTION

The present invention relates to sound enclosures and, more particularly, to sound enclosures for compressors.

BACKGROUND OF THE INVENTION

Continued efforts to reduce compressor weight and cost have led heating and cooling equipment manufactures to replace metal components with lighter mass materials. Often, these changes lead to increase in noise transmission from compressor units. Compressors currently sold to original equipment manufacturers are segregated into several feature categories. Significant feature categories typically considered include cost, temperature performance, aesthetics, recycling aspects and noise abatement performance.

Although single frequency sound cancellation schemes have been proposed in the heating and cooling industry, heretofore, no solution has been found to satisfactorily address the broad spectrum noise cancellation signature of a compressor. As shown in FIG. 1, soft fiber filled bags, which are placed over the compressor, have in the past been provided to reduce noise transmissions from the compressors. Such attempts to meet consumers needs have encountered manufacturing and performance issues. As such, there remains significant room for improvement in low cost noise abatement for compressor systems.

No one has taken the approach of incorporating the noise shielding function into a substantially solid plastic shell, which completely encloses a compressor, nor have superior sound transmission loss materials been used in air compressor sound suppression. Accordingly, there remains a need in the art for an air compressor system having a compact, improved noise absorption and attenuation characteristics, which operate collectively to reduce compressor noise economically, in a highly reliable manner.

SUMMARY OF THE INVENTION

The present invention provides an improved sound attenuating shell for a scroll compressor that provides significantly improved noise reduction at low cost. Materials having superior sound transmission loss properties are combined with a barrier construction especially suited to provide increased absorption, and superior sound transmission loss properties.

In one embodiment, the invention provides a sound attenuating chamber for a scroll compressor having a base member configured to support the compressor, the base defines a first chamber filled with a sound attenuating material. The sound attenuating chamber further has a cover member configured to cover the compressor and couple to the base, said cover member defines another chamber. This chamber is additionally filled with a sound attenuating material.

In yet another embodiment, a two layer compressor shell cover is formed of a polymer resin which defines an internal chamber. Optionally, the internal chamber of the shell has non-uniform thickness. The thickness of the internal cavity is preferably greatest over preselected areas from which emanate noise transmissions having larger amplitude, to increase noise transmission losses.

In another embodiment of the invention, a sound enclosure is provided for surrounding the shell of a compressor. The sound enclosure is vibrationally isolated from the compressor and has a mass density in $lb/ft^2$ to reduce the transmitted noise from the compressor by greater than 10 dB.

The present invention incorporates barrier and absorption technologies in plastic constructions thereby reducing overall noise transmittance while at the same time reducing space, complexity and cost requirements of existing technologies.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses. While the sound attenuating dome described is described as being associated with a compressor and more particularly a scroll compressor, it is envisioned that the teachings herein are equally applicable to other applications including but not limited to, valving, aerator assemblies, engine and motor assemblies for use in domestic, transportation, and manufacturing environments.

Figure 1:
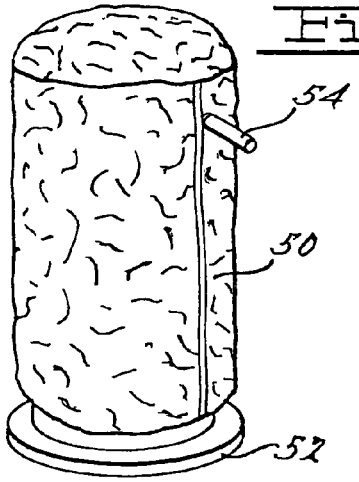
FIG. 1 represents a compressor sound covering according to the prior art.
Figure 2:
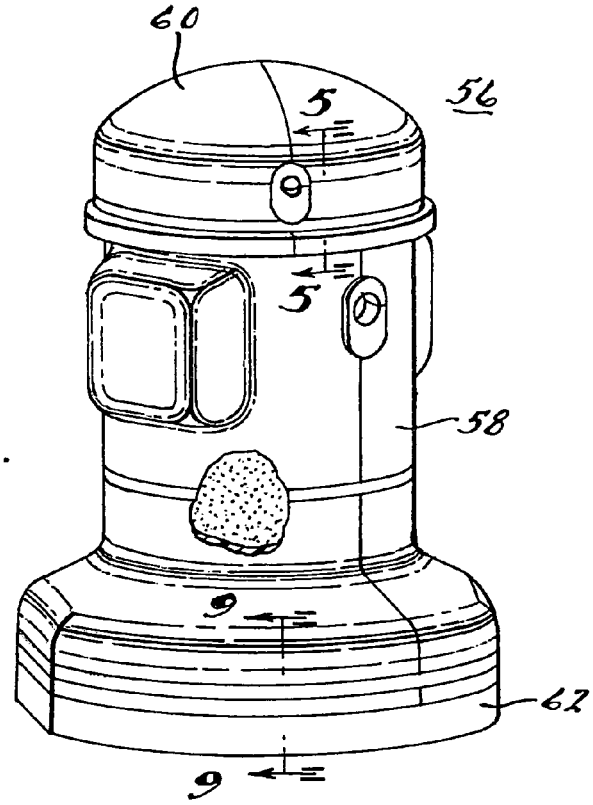
FIG. 2 represents a sound enclosure for a compressor according to the teachings of the present invention.

FIG. 2 represent a sound enclosure 56 having separable shell members. As can be seen, the sound enclosure 56 is formed of at least one side shell member 58, a cap shell member 60, and a base shell member 62. The sound enclosure is configured to completely surround a scroll compressor 52. Of particular significance is that the sound enclosure positions sound attenuating material at and around the base of the scroll compressor 52 to attenuate broad band noises generated therein. As described further below, the sound enclosure 56 defines a plurality of apertures which allow for suction, power, and pressure line couplings.

The sound enclosure 56 can be classified as a "complete enclosure" with preferably less than about 5% leakage. The walls of the sound enclosure 56 provide transmission loss (TL) governed by a transmission law.

$$TL=20 \log w+20 \log f-33.5$$

Where "w"=mass density lb/ft$^2$ and f=frequency

In this regard, the sound enclosure 56 is optionally configured to have an effective mass density for acoustic frequencies greater than 100 Hz and less than 20 kHz to provide a transmission loss of more than about 10 dB, and optionally more than 15 dB at between about 100 and about 1000 Hz. The compressor 52 is isolated from the structure with the use of elastomeric isolators located at the feet of the compressor 22 and around the suction and discharge lines. The elastomeric isolators reduce structural vibration transfer paths to the sound enclosure 56. The isolators also help to minimize the leakage of acoustical energy from the sound enclosure.

Figure 3:
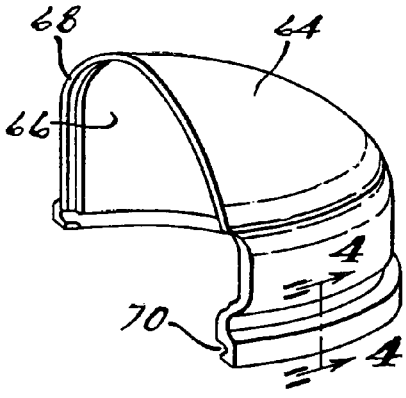
FIG. 3 represents a cap shell according to the teachings of FIG. 2.

FIG. 3 represents the cap shell 60 shown in FIG. 2. The cap shell 60 has an outer surface 64, an inner surface 66, and a coupling surface 68. Further defined on the inner surface 66 is a coupling portion 70 which is configured to lockably engage the cap shell 60 to the side member 58. As described below, frangible straps are used to hold the members together and about the compressor 52.

Figure 4:
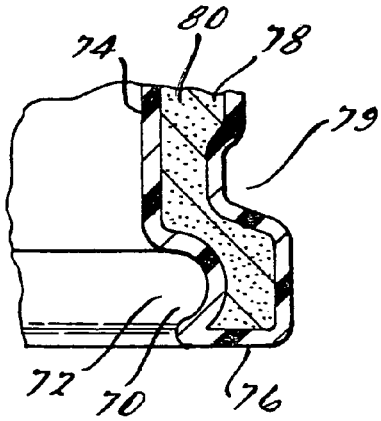
FIG. 4 represents a coupling mechanism for the cap shell according to the teachings of FIG. 3.

As shown in FIG. 4, the coupling portion 70 has an inner concave mating surface 72 disposed on an inner surface 66. Disposed between the outer surface 64 and inner surface 66 is a lower mating surface 76. Further disposed between outer surface 64 and inner surface 66 is a defined inner cavity 78 which extends into the coupling portion 70. Disposed within the inner cavity 78 is a sound dampening or attenuating material such as sand, slag or other sound dispersing aggregate. It is further envisioned that the sound dampening material can be a bi-phase liquid such as an emulsion. As further described below, the outer surface of each of the members can define an exterior groove 79, which is configured to hold the straps.

Figure 5:
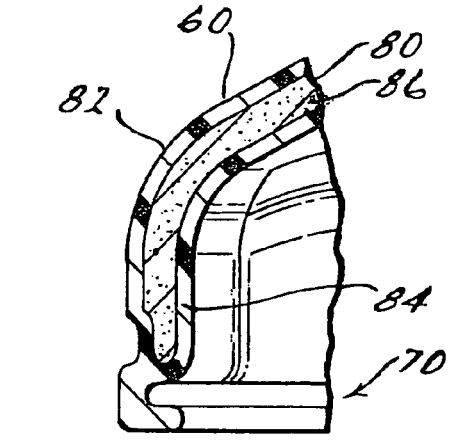
FIGS. 5-9 represent alternate coupling mechanisms according to the teachings of the present invention.

FIG. 5 represents an alternate cap shell 60. The cap shell 60 has a defined outer surface 82 and a defined inner surface 84 and an alternate interior cavity 86 which does not extend into the coupling region 70. Similarly, shown in FIG. 6, a base member 62 can have a coupling member 88 without an inner cavity. The base shell member 62 defines a circular base support member 92 which defines a through bore 94 that is configured to allow the disposition of a mounting fastener (now shown) from the compressor 62.

Figure 7:
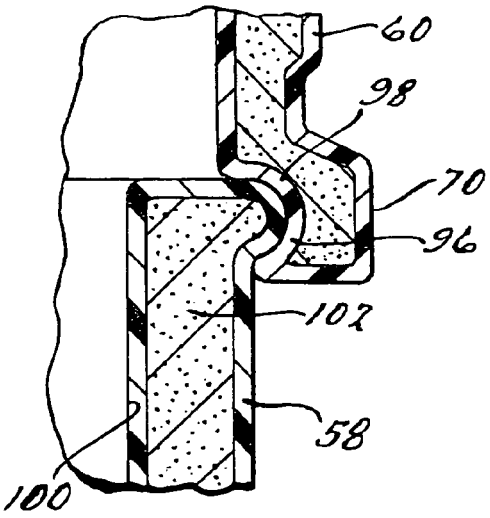

FIG. 7 shows a view of the inner face of a cap shell 60 having a coupling region 70 attached to the mounting surface of side shell 58. The coupling region 70 defines a concave surface 96 which is configured to mate with a convex mating surface 98 formed on the side shell 58. The inner surface 100 and the outer surface define the inner cavity 102 which extends into the coupling region 70 and is filled with sound dampening material.

Figure 8:
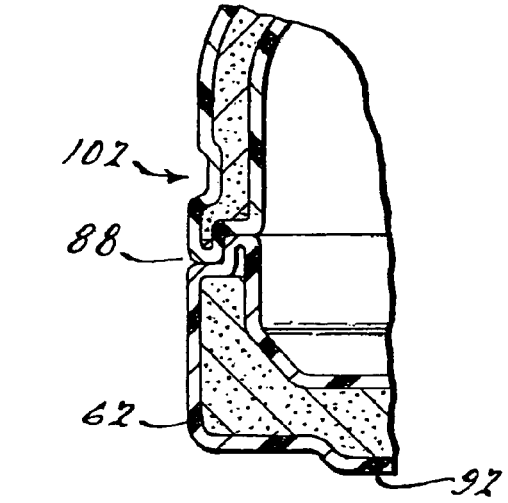

FIG. 8 represents a cross-section of the coupling region for the side shell 58 with the base member 62. The shells and coupling members are preferably formed of relatively stiff thermoset materials. In this regard, it is envisioned that the shells can be formed of materials such as, but not limited to, epoxy, nylon, polypropylene, TPE or TPO.

Figure 6:
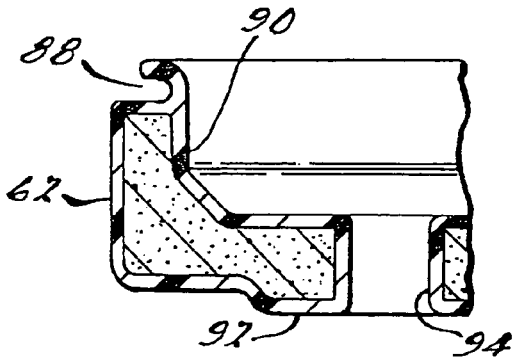
Figure 9:
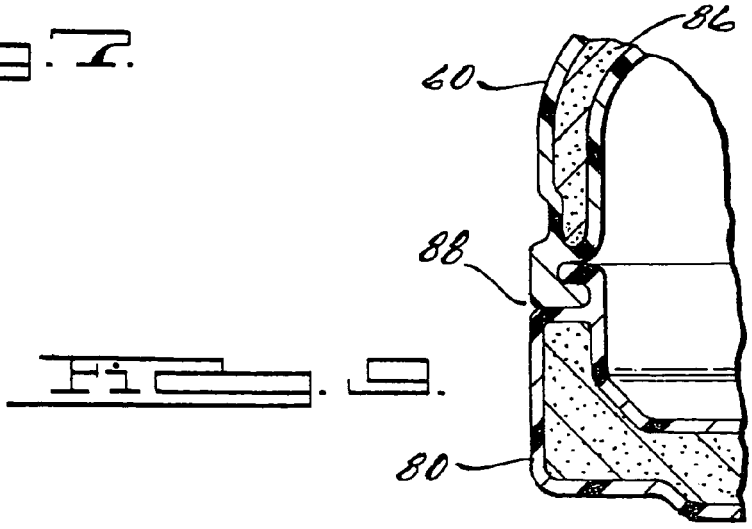

With brief reference to FIGS. 5, 6 and 9 which represent the coupling mechanism of either the cap 60 or side shell 82. As can be seen, the coupling mechanism 88 defines a first hook shaped portion 90 which interfaces with a corresponding hook. Although cavities that hold the sound attenuating material 80 do not extend into the coupling mechanism 88, the coupling mechanism 88 fluidly seals the interior of the shell 56 from the outside.

Figure 10:
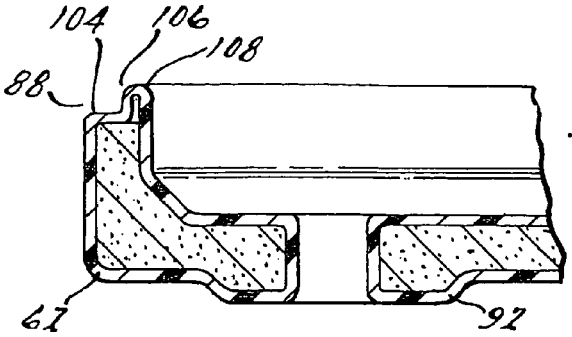
FIG. 10 represents a sectional view of a base shell shown in FIG. 2.

FIG. 10 represents an alternate coupling mechanism of the base 62. A coupling mechanism 88 has a generally horizontal support face 104 and a vertical stop base 106 defined at an upper edge 108. The horizontal support face slidably supports a corresponding coupling region on the side shell 58 when the components are brought together around the compressor 57.

Figure 11:
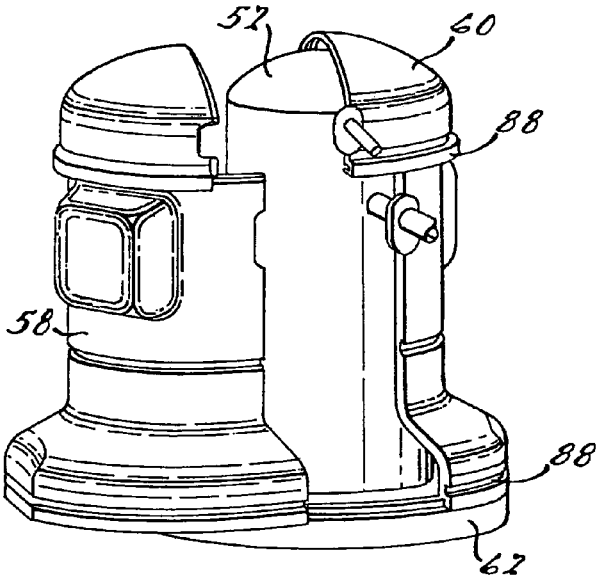
FIGS. 11-13 represent the assembly of the acoustic shell shown in FIG. 2.
Figure 12:
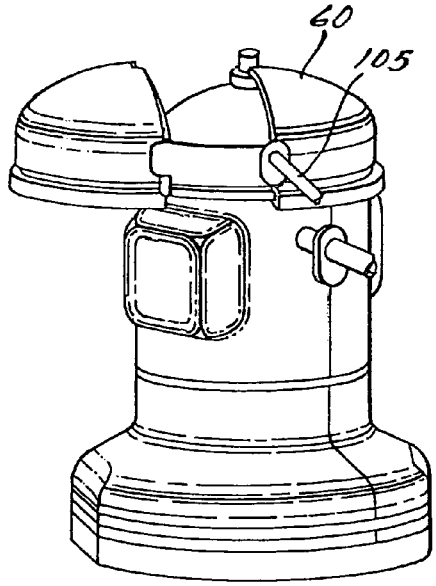
Figure 13:
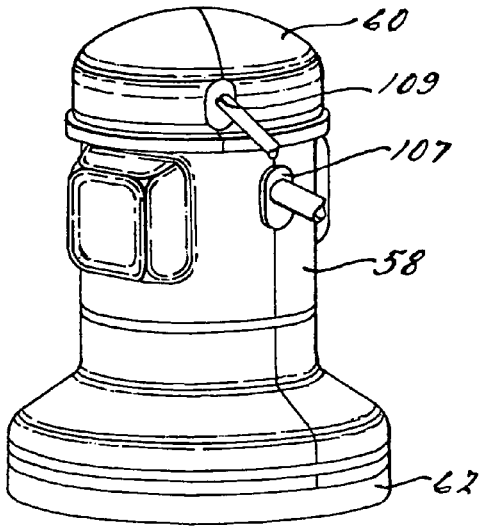

FIGS. 11-13 represent the assembly of the sound attenuating shell about the compressor 52. As can be seen, the compressor 52 is disposed onto the supporting base 62. The side shell members 58 are slid onto the base so as to engage the lower locking mechanism 88. Next, the cap shells 60 are slid onto the upper locking mechanism 88 of the shell 58 so as to cover the top of the compressor 52. As best seen in FIG. 13, the cap shell 60 and side shells 58 are formed of two or more separable pieces. Disposed between the junction of the two separable pieces are defined apertures 105 and 107. These apertures are used to bring suction and pressure lines into the compressor body. Disposed about those lines are appropriately sized grommets 109 which acoustically isolate the interior of the acoustic chamber from the outside. As can be seen, the cap shell 60 can additionally have a thermally activated check valve 61. This thermally activated check valve 61 is designed to open at a predetermined temperature to allow for heated gases from the interior of the sound attenuator to leave when the temperature reaches a predetermined level.

Figure 14A:
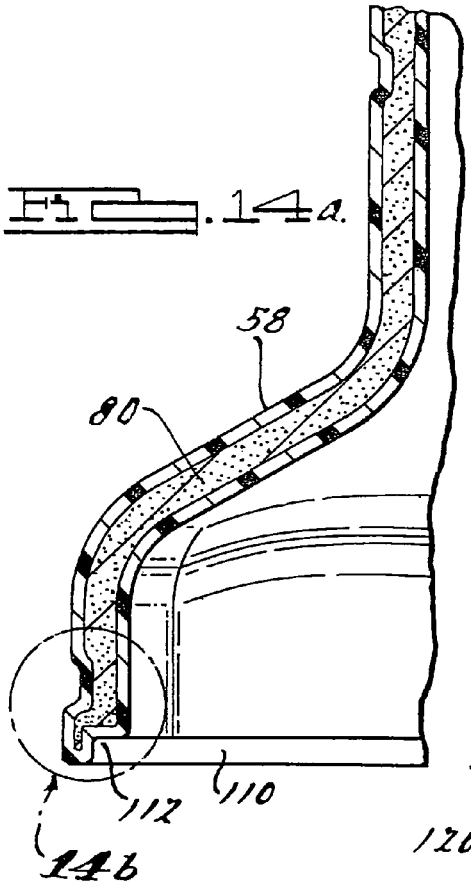
FIGS. 14*a* and 14*b* represent alternate coupling mechanisms for side shells shown in FIG. 2.
Figure 14B:
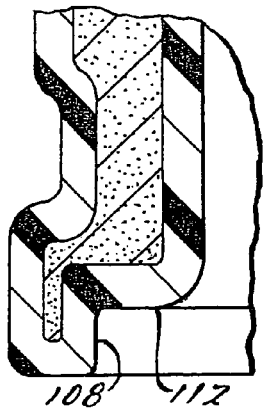

FIGS. 14*a* and 14*b* represent the coupling mechanism of the side shells 58 which is positioned over the base member 62. Disposed along the perimeter 118 of the base member 62 is a shelf portion 120 which slidably supports a portion of the locking mechanism 88. As best seen in FIG. 14*b*, the mating surface 112 supports the side shell 58 as it is being slid onto the base 62. It should be noted that the base 62 additionally has a pair of flat surfaces 121 which are used to rotationally orient the side shell members 58 with the base 62.

Figure 15:
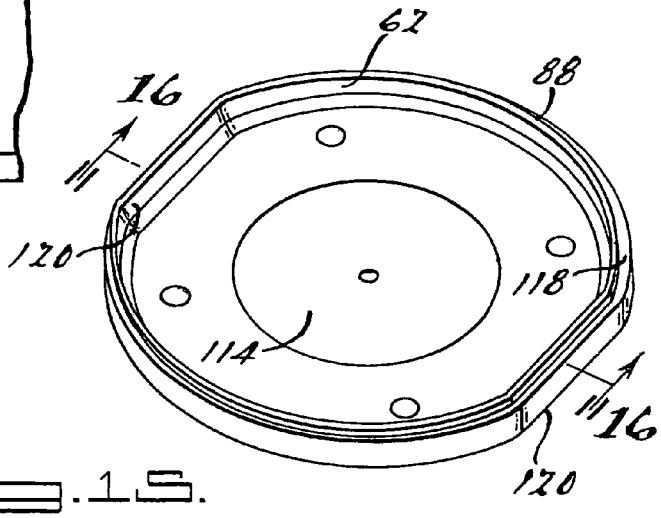
FIGS. 15-16 represent perspective and cross-sectional side views of an alternate base shell.
Figure 16:
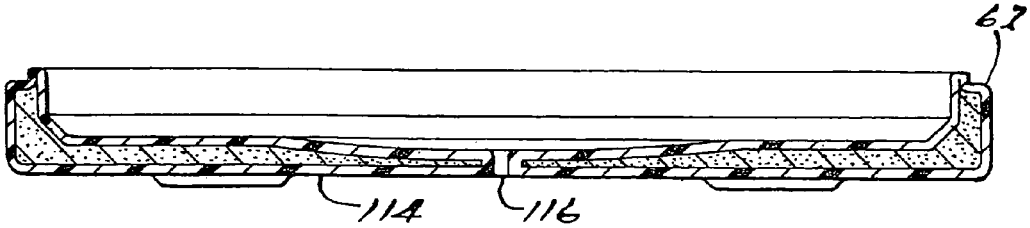

FIGS. 15 and 16 represent perspective and cross-sectional views of the base shell 62. As can be seen, defined in a lower portion of the base is a fluid trap 114 which is used to accumulate and allow the drainage of liquid from condensation from the compressor. In this regard, the base member 62 further defines an aperture 116 to allow for the drainage of fluid.

Figure 17:
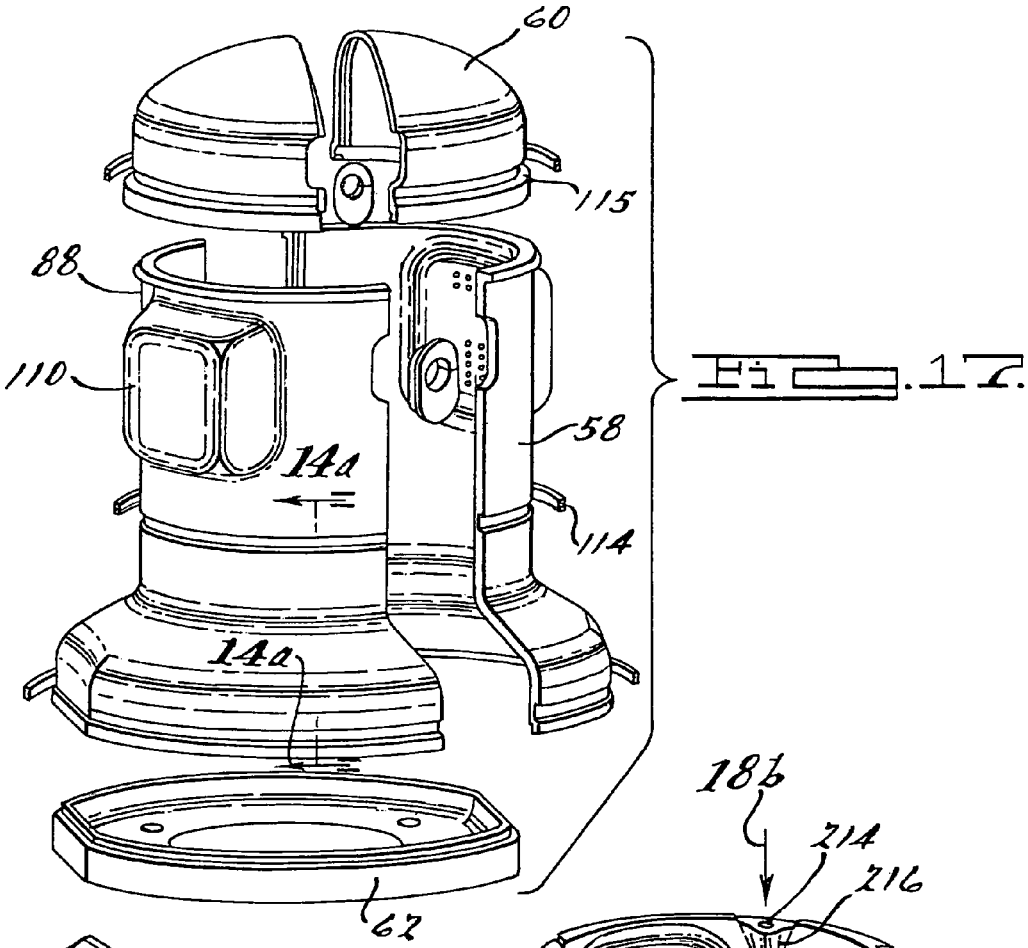
FIG. 17 represent an exploded view of alternate acoustic shell.
Figure 18B:
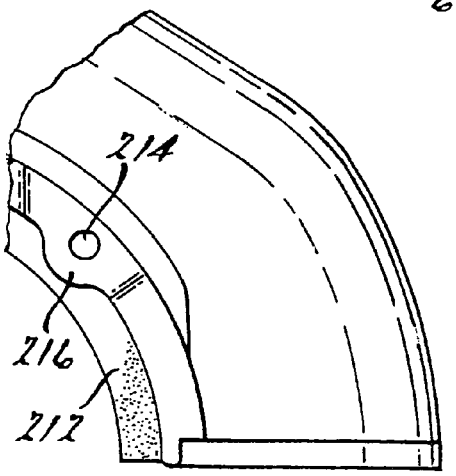
FIGS. 18*a* and 18*b* represent an internal view of a side shell shown in FIG. 17.
Figure 18A:
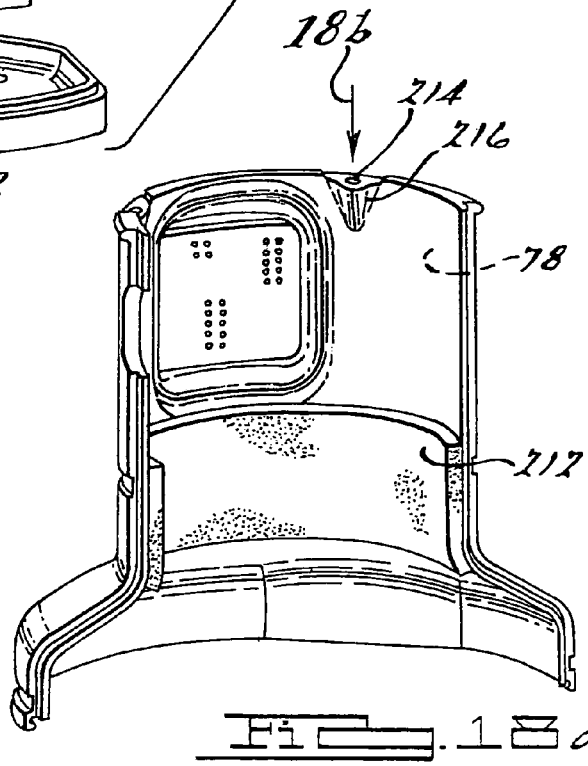
Figure 19:
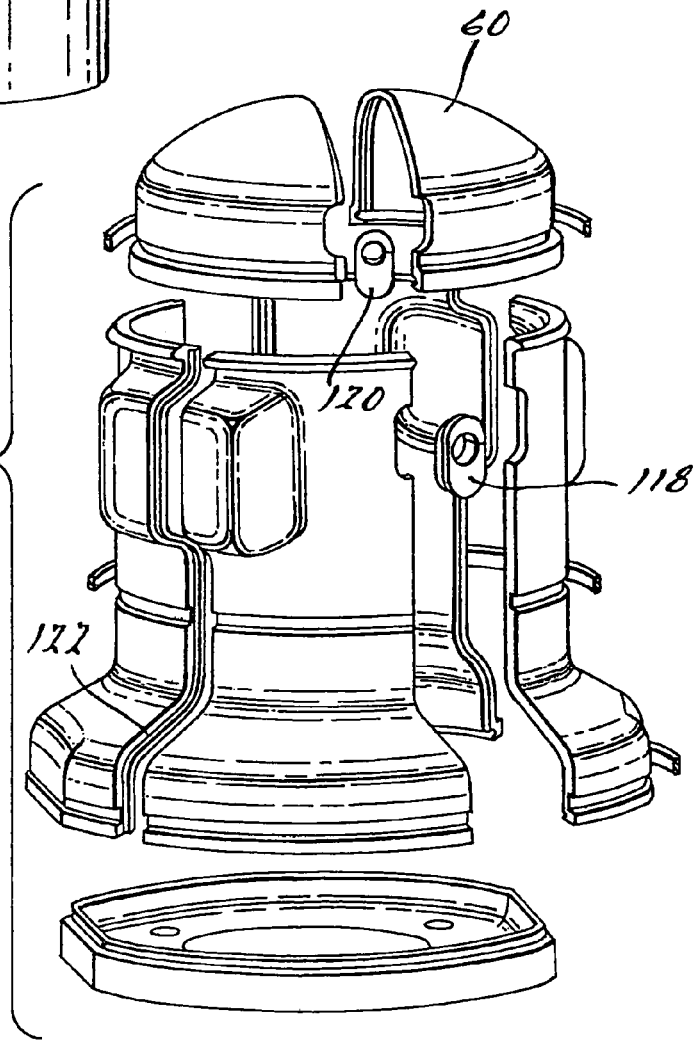
FIG. 19 represents an exploded view of an alternate acoustic enclosure.
Figure 22:
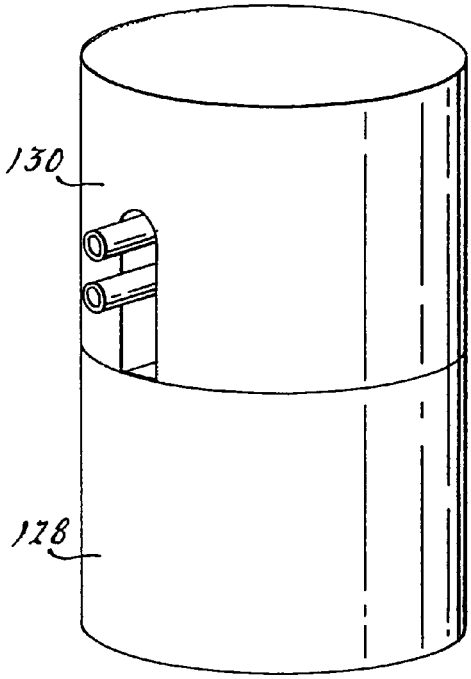

FIGS. 17-19 represent alternate views of the sound attenuating shell according to an alternate design. As can be seen, straps 114 are provided which surround and lock the sound attenuating chamber about the compressor 52. These locking straps 114 are generally disposed within the notches 115 on the exterior surface of the cap shell 60 and the side shell members 58. It should be noted that the side shell members 58 can define cavities or depressions 110 to hold electronic controls 116 for the compressor 52 within the sound attenuating chamber. These electronic controls 116 can regulate all of the functions of the compressor 58. For ergonomic reasons, it should be noted that the components of the sound attenuating chamber could be divided into a plurality of coupleable components.

As best seen in FIGS. 18*a* and 18*b*, the compressor can optionally contain a strip or layer 212 of open or closed cell low-density foam. This foam 212 is positioned within the chamber formed by the enclosure 56 in a manner which reduces the occurrence of standing acoustic waves within the chamber formed by the enclosure 56. The low density foam 212 is preferably positioned in a location where it does not come into contact with the compressor shell. Optionally, each of the shell components define a hole 214 that allows for the filing of the inner cavity 78. In this regard, a portion of the inner cavity 78 can define a funnel portion 216 to assist in the filling of the cavity. As seen in FIG. 19, the side shell members 58 can be divided into a number of components to keep the weight to preferably less than about 5 lbs. The number and size of the components is a function of the size of the compressor 52.

Figure 20:
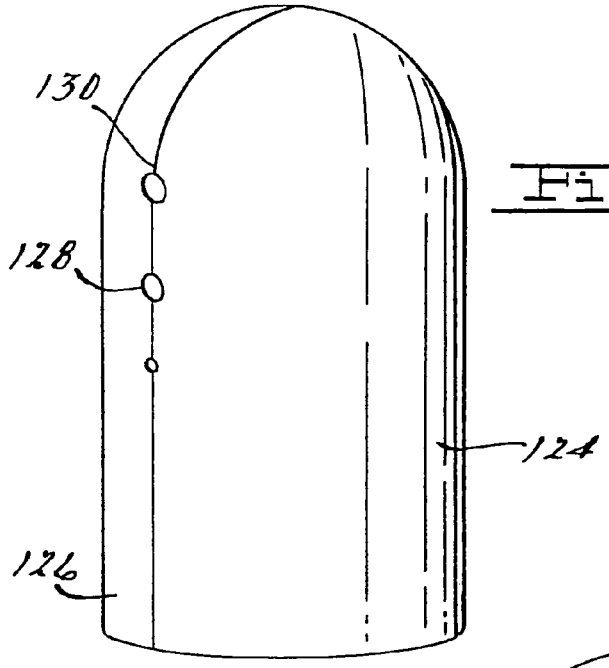
FIGS. 20-28 represent alternate acoustic shells according to the teachings of the present invention.
Figure 23:
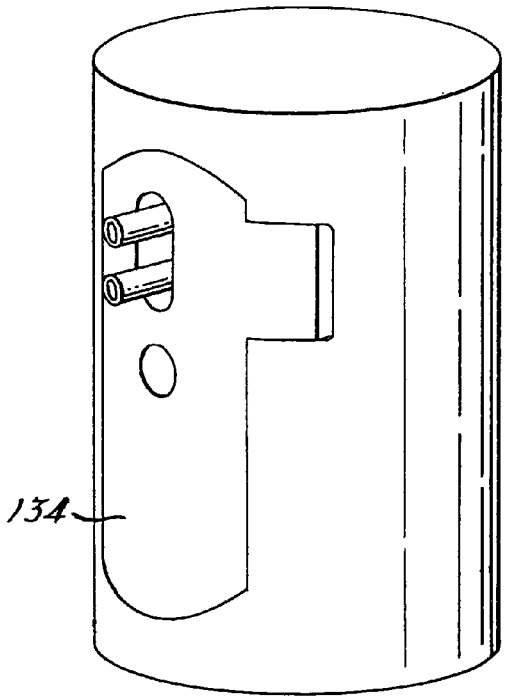
Figure 21:
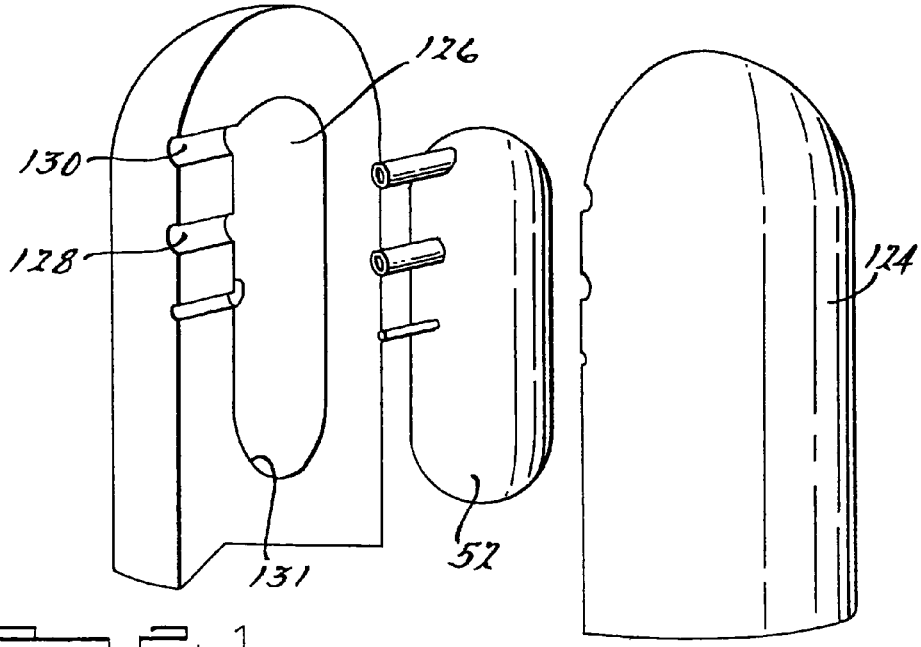
Figure 26:
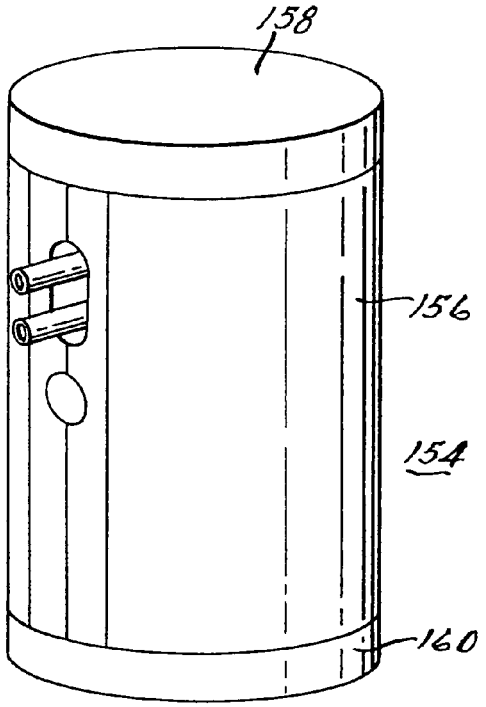
Figure 25:
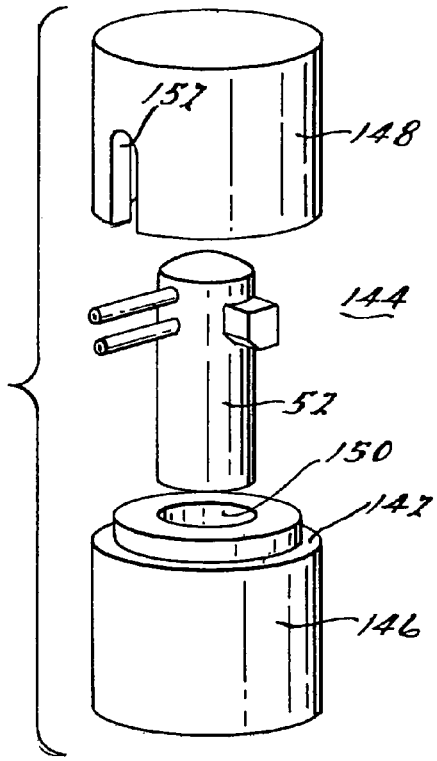
Figure 24:
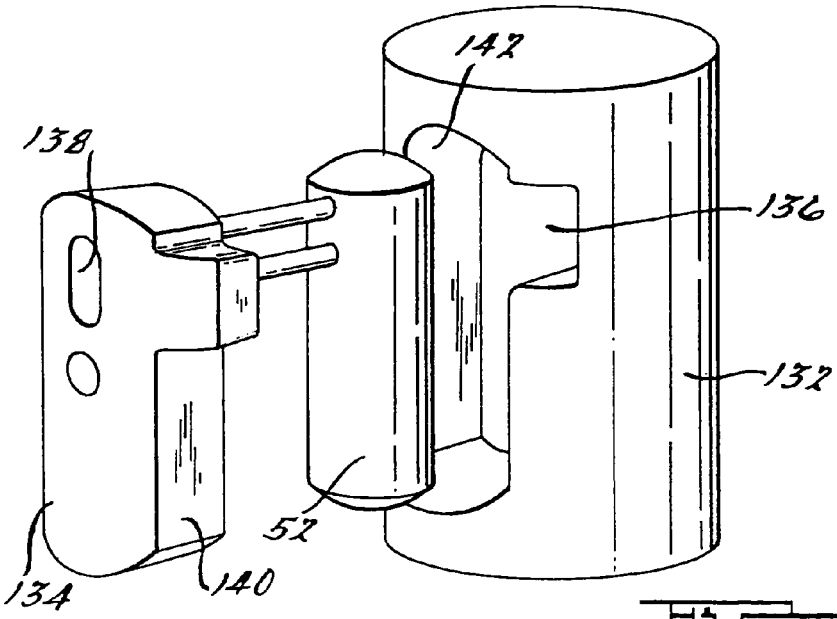

As can be seen in FIGS. 20-27, the entire sound attenuating system 56 can take the form of a pair of hollow shell members filled with sound attenuating materials. As shown in FIGS. 20 and 21, it is envisioned that each of the shell members 124 define an internal cavity 126 to support the compressor 52. The support surface can either be defined by a single portion of the hollow shell members or can be formed by two or more members. As previously mentioned, the shell members 124 can have defined apertures for suction or pressurized air 128 and 130. The interior cavity 126 defines a base port area 131 which is configured to support the bottom of the compressor 52. FIGS. 23 and 24 show that a compressor 52 can be slid into a cavity 136 within one of the members. The second member 134 can be used to encapsulate the compressor 52.

Figure 27:
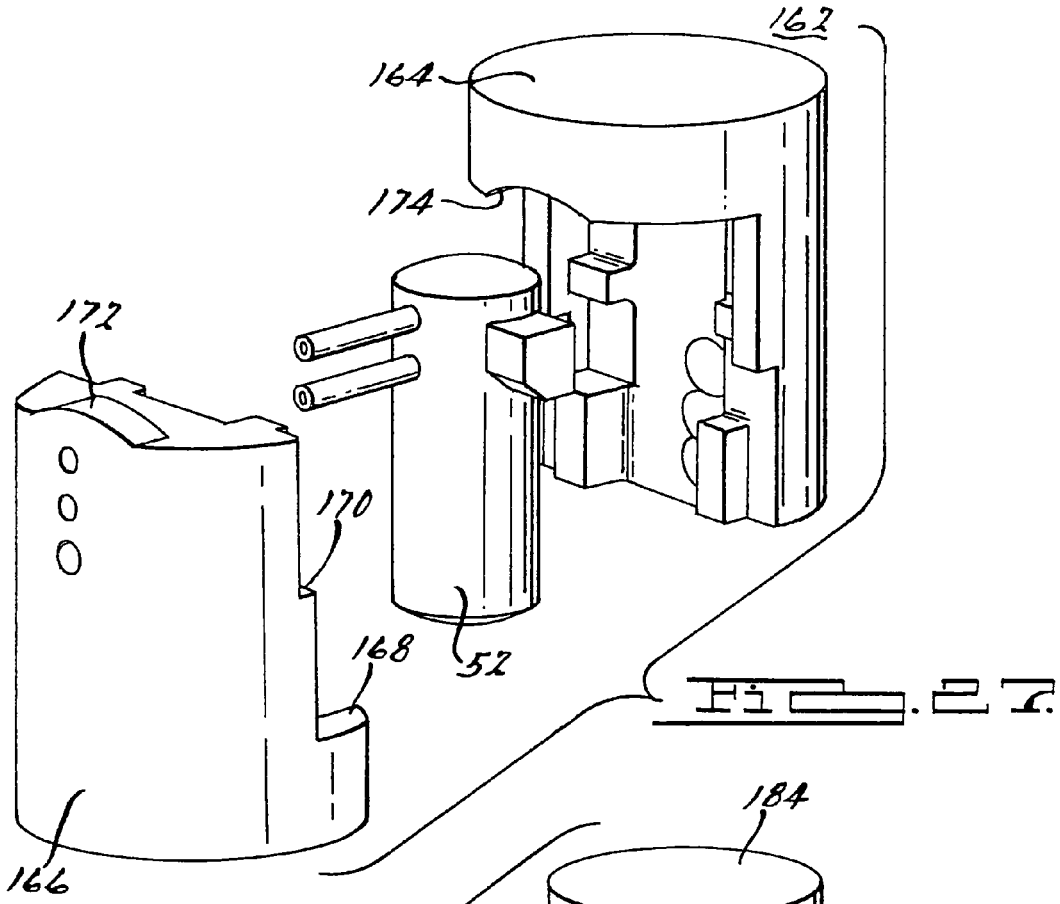
Figure 28:
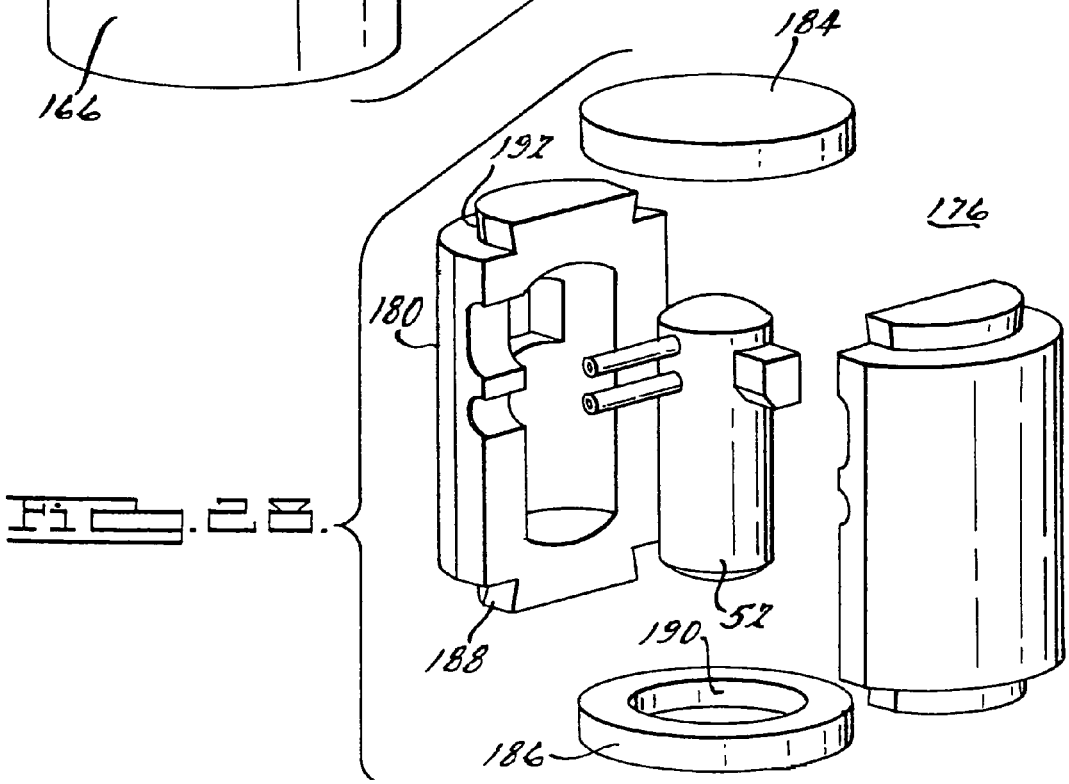

Either the first or the second member can have defined apertures 138 for accepting the suction or compressed air lines. As shown in FIG. 27, the shell members 164 and 166 can have numerous interlocking surfaces and flanges 168-174 to encapsulate support and surround the compressor 52. As shown in FIG. 28, an alternate embodiment 176 of the sound attenuating shell is disclosed. The shell includes a cap member 184 and a base member 186 which are configured to interlock with surfaces 192 and 188 to hold a pair of shells 178 and 180 about the compressor 152.

Figure 29:
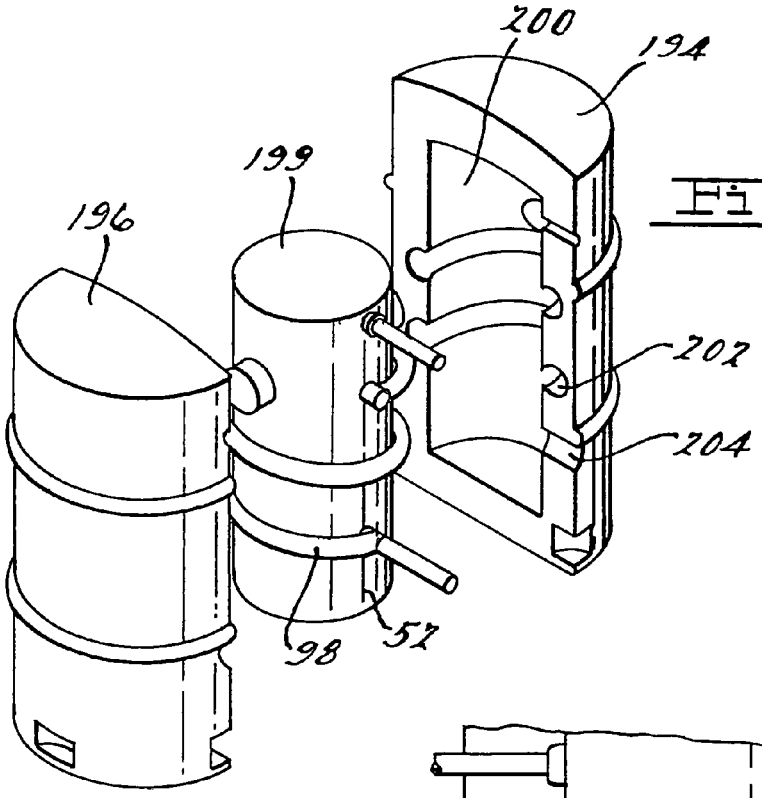
FIGS. 29 and 30 represent acoustic shells utilizing a quarter wave pipe sound cancellation mechanism.
Figure 30:
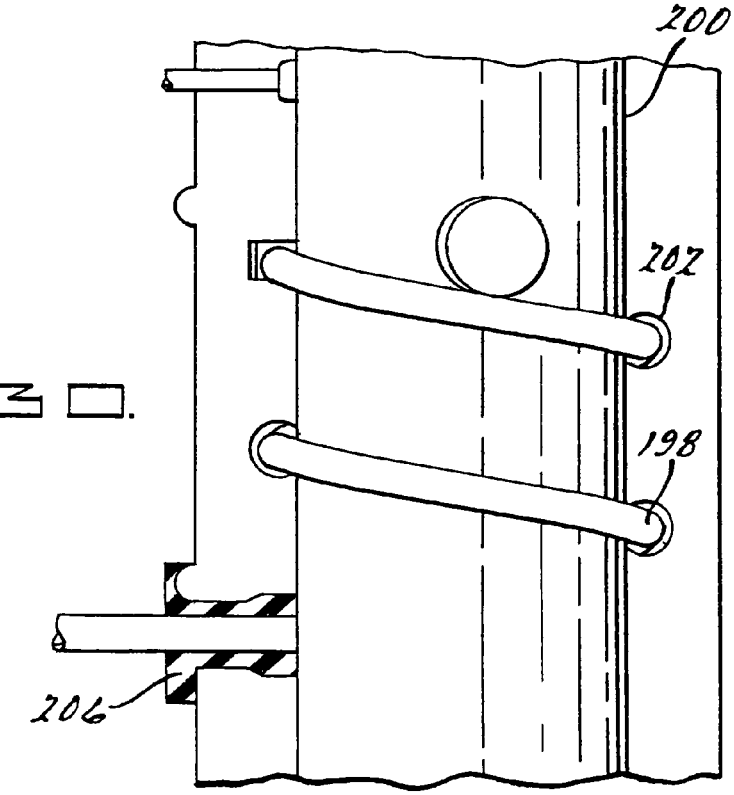

FIGS. 29 and 30 represent an alternate embodiment of the present invention. Shown is a scroll compressor 52 having a quarter-wave resonator tube 198 disposed about the shell 199 of the compressor. The quarter-wave resonator tube functions to reduce noise from the compressor output a specific frequency. The shell members 194 and 196 have an interior surface 200 which define a serpentine groove 202. This serpentine groove 202 is configured to encapsulate and hold the quarter wave tube 198. As can be seen, fluidly coupling the interior cavity to the exterior shell is an aperture 204. Disposed within the aperture 204 is a grommet 206 to fluidly seal the sound attenuating chamber.

Figure 31:
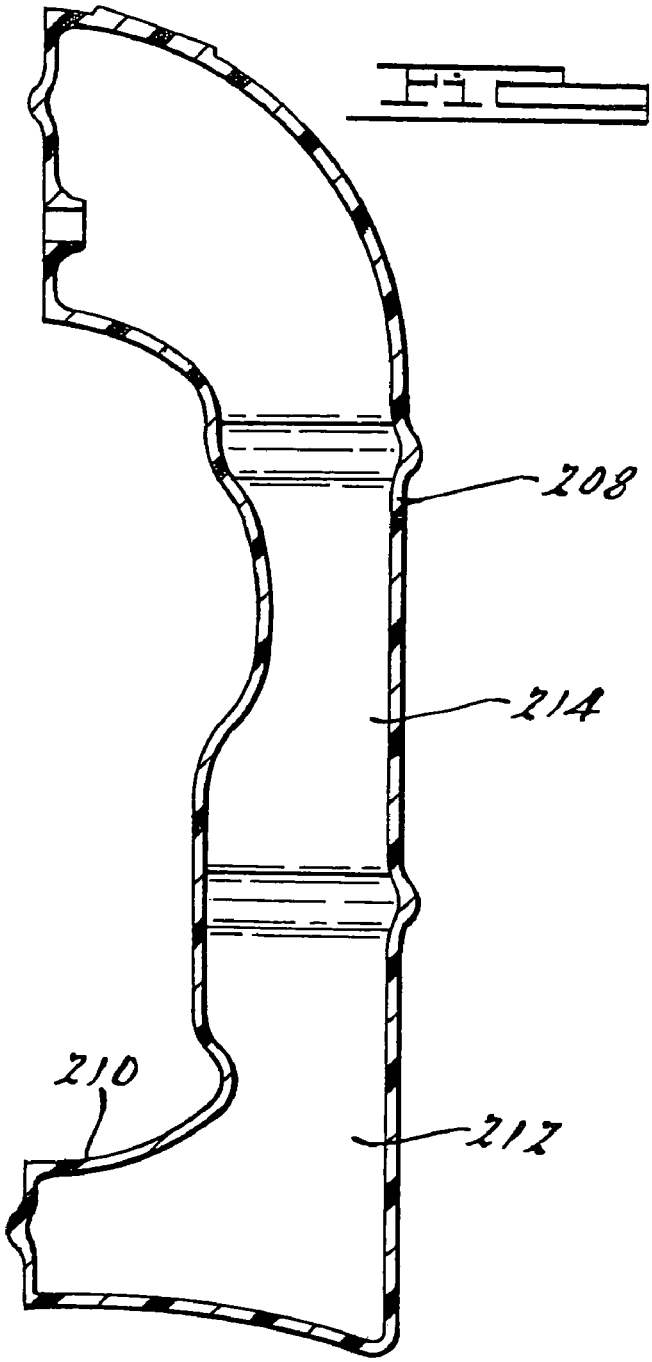
FIG. 31 represents an acoustic shell which utilizes liquid to dampen noise transmission from an associated compressor.

FIG. 31 represents an alternate embodiment. Shown is a hollow blow molded shell 208 defining a support surface 210 and an interior cavity 212. It is envisioned that this interior cavity 212 can be filled with bi or tri-phase fluid mixtures such as glycerin or oil and water which can be used to attenuate the noise signal produced from a compressor 52. This bi-phase material is preferably an emulsion which attenuates sound transmissions.

Figure 32:
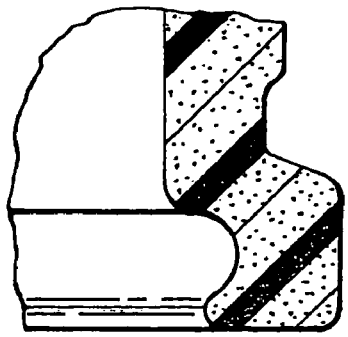
FIG. 32 represents a portion of a solid acoustic shell to dampen noise transmission from the compressor.

FIG. 32 represents a cross-sectional view of an alternate sound compressor enclosure 56. The enclosure 56 is solid and provides a transmission loss of greater than about 10 dB. In this regard, the enclosure 56 is formed of a polymer material having sufficient mass density to provide greater than about 10 dB. The polymer may have filler incorporated therein to increase the mass density and, therefore, the transmission loss.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A chamber comprising:

a base member configured to support a compressor;

a cover member coupled to said base member and forming an inner volume between an inner surface of said cover member and said based member to house the compressor therein, said cover member including a first chamber volume isolated from said inner volume, a pair of side members configured to cover the compressor and a two-piece cap member having an integrally formed first locking mechanism; and a first sound absorbing material located within said first chamber volume.

2. The chamber according to claim 1, further comprising isolating members located between feet of the compressor and the base member to isolate the chamber from the compressor.

3. The chamber according to claim 1, wherein one of said base member and said cover member is formed of a material having a mass density sufficient to produce a transmission loss of greater than 10 dB for a sound frequency between 100 and 1000 Hz.

4. The chamber according to claim 1, wherein said cover member is formed from a thermoset material.

5. The chamber according to claim 1, wherein an air gap is located between the compressor and an inner wall of said cover member, a first acoustic impedance being formed by said air gap and a second acoustic impedance being formed by said inner wall.

6. The chamber according to claim 1, further comprising a strap configured to hold the side members together.

7. The chamber according to claim 1, wherein one of said side members includes an integrally formed second locking mechanism configured to couple to said first locking mechanism.

8. The chamber according to claim 7, wherein said first locking mechanism includes one of a concave surface and a convex surface and said second locking mechanism includes the other of said concave surface and said convex surface.

9. The chamber according to claim 1, wherein said cap member defines a cavity filled with a second sound absorbing material.

10. The chamber according to claim 1, wherein said cap member defines a thermally activated check valve.

11. The chamber according to claim 1, wherein said base member defines a cavity filled with a second sound absorbing material.

12. The chamber according to claim 1, wherein said first sound absorbing material is an aggregate.

13. The chamber according to claim 12, wherein said aggregate is at least one of sand and slag.

14. The chamber according to claim 1, wherein said first sound absorbing material is a fluid.

15. The chamber according to claim 14, wherein said fluid is at least one of glycerin, oil, and water.

16. The chamber according to claim 1, wherein at least one of said cover member and said base member is formed of a polymer material.

17. The chamber according to claim 3, wherein the other of said base member and said cover member is at least partially formed of a material having a mass density sufficient to produce a transmission loss of greater than about 10 dB.

18. The chamber according to claim 1, further comprising a foam member disposed between the compressor and at least one of said base member and said cover member.

19. The chamber according to claim 18, wherein said foam member is separated from the compressor.

* * * * *